US010619362B2

(12) United States Patent
Hyde, III

(10) Patent No.: US 10,619,362 B2
(45) Date of Patent: Apr. 14, 2020

(54) DEVICES AND METHODS FOR PREPARING DRYWALL BUTT JOINTS

(71) Applicant: Charles Hyde, III, Mililani, HI (US)

(72) Inventor: Charles Hyde, III, Mililani, HI (US)

( * ) Notice: Subject to any disclaimer, the term of this patent is extended or adjusted under 35 U.S.C. 154(b) by 246 days.

(21) Appl. No.: 15/647,572

(22) Filed: Jul. 12, 2017

(65) Prior Publication Data

US 2018/0298623 A1 Oct. 18, 2018

Related U.S. Application Data

(60) Provisional application No. 62/484,944, filed on Apr. 13, 2017.

(51) Int. Cl.

| | |
|---|---|
| ***E04F 21/00*** | (2006.01) |
| ***B25F 1/00*** | (2006.01) |
| ***B25F 5/02*** | (2006.01) |
| ***B25G 1/10*** | (2006.01) |
| ***E04F 21/06*** | (2006.01) |

(52) U.S. Cl.

CPC ..... *E04F 21/0046* (2013.01); *B25F 1/00* (2013.01); *B25F 5/02* (2013.01); *B25G 1/102* (2013.01); *E04F 21/06* (2013.01)

(58) Field of Classification Search

CPC ..... B26B 11/00; B26B 11/006; B26B 5/00; B26B 5/005; B26B 5/001; B25G 1/00; B25G 1/10; B25G 1/066; B25G 1/04; B25G 1/06; B25G 1/102; E04F 21/32; E04F 21/0046; E04F 21/026; E04F 21/06; E04F 21/165; B25F 1/00; B25F 5/02; B44C 7/02; B44C 7/027

USPC ..... 7/105, 158; 81/52; 29/244

See application file for complete search history.

(56) References Cited

U.S. PATENT DOCUMENTS

| | | | | |
|---|---|---|---|---|
| 4,495,697 | A | 1/1985 | Ruff | |
| 4,974,320 | A | 12/1990 | Pelletier | |
| 5,623,737 | A * | 4/1997 | Moyer, Jr. | B26B 5/00 30/125 |
| 6,023,846 | A | 2/2000 | Crawford et al. | |
| 6,662,521 | B1 * | 12/2003 | Escobedo | B25B 15/00 362/119 |
| 8,245,753 | B2 * | 8/2012 | Haemerle | B26B 5/00 156/579 |
| 2002/0040561 | A1 * | 4/2002 | Henits | E04F 21/00 52/749.1 |
| 2007/0033740 | A1 | 2/2007 | Dehner | |
| 2011/0225831 | A1 | 9/2011 | Greenwood | |
| 2011/0302786 | A1 * | 12/2011 | Sannah | B26B 11/00 30/143 |
| 2012/0090264 | A1 | 4/2012 | Goss | |
| 2013/0145909 | A1 * | 6/2013 | Rogers | B25G 1/102 81/492 |

* cited by examiner

*Primary Examiner* — David B. Thomas

(74) *Attorney, Agent, or Firm* — Capital Patent & Trademark Law Firm, PLLC

(57) ABSTRACT

A simple device for preparing a drywall butt joint includes a wheel with beveled surfaces or an end taper. When the device makes contact with protruding, rough edges of a drywall butt joint and/or debris surrounding the butt joint the force applied by the device eliminates the protruding, drywall edges and debris.

14 Claims, 5 Drawing Sheets

DEVICES AND METHODS FOR PREPARING DRYWALL BUTT JOINTS

RELATED APPLICATION

The present application is related to, and claims the benefit of priority from, U.S. Provisional Application No. 62/484,944 filed Apr. 13, 2017 (the '944 Application) and incorporates by reference the disclosure of the '944 Application as if set forth in full herein.

INTRODUCTION

The construction tools and materials involved in hanging and finishing drywall have advanced in many aspects through the decades that the product has been used in the formation of interior walls within homes and businesses. One relatively recent advance has been the development of a fiberglass-based mesh tape (hereinafter referred to as "fibertape") that is used to cover the joints between adjacent sheets of drywall (prior to being coated and finished with joint compound). In contrast to conventional paper tape, the fibertape has a sticky side (similar to masking tape), which enables fibertape to be positioned in place without the need for joint compound or any other adhesive.

While fibertape is useful when joining two "finished" drywall edges (i.e., the beveled, paper-covered factory-finished ends), it has been known to experience problems when used to join together rough, unfinished drywall edges (hereinafter referred to as "butt joints"). In particular, it has been found that when using fibertape over a butt joint, the various tears and frayed edges of the drywall (referred to here as "drywall debris") may stick out through the mesh of the fibertape and interfere with the ability to create a smooth, finished seam. Also, the raised/frayed edges of cut drywall often lift the fibertape so that portions of it are (unintentionally) sanded between coats of joint compound. The undesirable sanding of portions of the fibertape weakens the entire span of the fibertape and leads to the formation of hairline cracks in the vicinity of the butt joint. FIG. 1 illustrates an exemplary butt joint 1 between cut edges 2*a*,2*b* of drywall section A and drywall section B, showing the presence of debris, raised edges, and the like 3*a*, along the joint 1.

It is desirable to provide improved devices and methods for preparing drywall butt joints that overcomes the disadvantages of existing methods and devices.

SUMMARY

One embodiment of a device for preparing a drywall butt joint may comprise the following, for example: a means for holding (e.g., a handle), a means for contacting edges of a butt joint (e.g., rotatable or fixed wheel, or end taper) operable to, and configured to, apply a force to protruding drywall edges and debris. Further, the means for contacting may comprise surfaces configured to eliminate the protruding edges and reduce the debris.

The surfaces of the means for contacting may be beveled surfaces with a circumferential ridge portion, for example, or tapered side surfaces and a rounded end surface.

In alternative embodiments, the means for contacting edges may be detachable from the means for holding, or replaceable.

Turning to the means for holding, it may comprise an adjustment means for turning at least the means for holding and/or the wheel means between 0 and 90 degrees from a referential, vertical position.

In another embodiment the device may include a blade connected to one end of the means for holding, wherein the blade is positioned on an end opposite the means for contacting. The blade may be used as a putty knife, for example.

In yet additional embodiments, the device may further comprise a gripping means for forming a secure connection between a user's hands or fingers and the device, means for illuminating a surface or butt joint and/or a motor means, connected to the means for contacting, for rotating a wheel, for example.

In addition to the devices described herein, the present invention also provides for related methods, such as methods for preparing a drywall butt joint. One such method comprises contacting protruding vertical or horizontal edges or debris of the butt joint with a means for contacting to apply a force to the edges and debris to eliminate the protruding edges and reduce the debris, where, again, the means may be rotatable or fixed, replaceable or detachable and may comprise beveled surfaces and a circumference ridge portion or tapered side surfaces and a rounded end surface.

In yet additional embodiments, the method may further comprise forming a secure connection between a user's hands or fingers and the device, illuminating a surface or butt joint and/or connected the wheel means to motor means for rotating the wheel means.

BRIEF DESCRIPTION OF DRAWINGS

FIG. 1 illustrates an exemplary butt joint between edges of two drywall sections showing the presence of debris, raised edges, and the like.

Additional devices and related methods, features and advantages of the invention will become clear to those skilled in the art from the following detailed description and appended drawings.

DETAILED DESCRIPTION, INCLUDING EXAMPLES

Exemplary embodiments of devices and methods for preparing drywall butt joints are described herein and are shown by way of example in the figures. Throughout the following description and figures, like reference numbers/characters refer to like elements.

It should be understood that, although specific exemplary embodiments are discussed herein, there is no intent to limit the scope of the present invention to such embodiments. To the contrary, it should be understood that the exemplary embodiments discussed herein are for illustrative purposes, and that modified and alternative embodiments may be implemented without departing from the scope of the present invention. For example, where specific dimensional or angular information is provided this information is merely exemplary and other dimensions and angles may be used depending on the application and embodiment.

It should also be understood that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed, and may also include additional steps not included in a description of the process/method.

As used herein, the term "and/or" includes any and all combinations of one or more of the associated listed items. As used herein, the singular forms "a," "an" and "the" are intended to include the plural form, unless the context and/or common sense indicates otherwise. As used herein the word "element" is intended to include the plural form, unless the context and/or common sense indicate otherwise. It should be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should be understood that when an element of a device is referred to as being "connected" to (or other tenses of connected) another element, such elements can be directly connected together or may be indirectly connected together using intervening elements to aid a connection. In the latter case, if the intervening elements are well known to those in the art they may not be described herein.

As used herein, the term "embodiment" refers to an example of the present invention.

Figure 2:
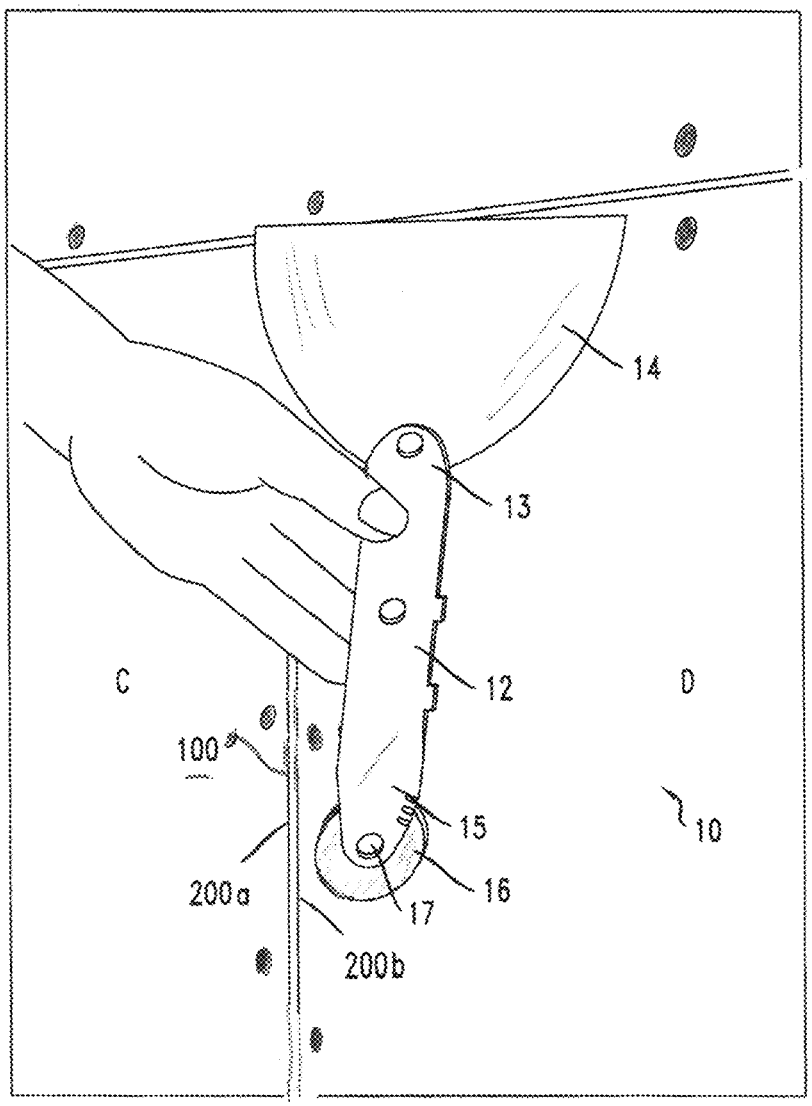
FIG. 2 illustrates an exemplary device in accordance with an embodiment of the present invention.

FIG. 2 illustrates an exemplary embedding tool 10, formed in accordance with an embodiment of the present invention. In one embodiment, the tool 10 may be used to prepare a butt joint 100 prior to the application of fibertape so that the rough edges and fibers of the pair of dry wall cut edges 200*a*,200*b* may be pushed below the surface of the joint 100, allowing the fibertape to smoothly and easily adhere to the surface of the pair of drywall boards C, D along the butt joint 100.

The exemplary embedding tool 10 may comprise a putty knife, including a means for holding 12 (e.g., a handle) a detachable or fixed blade 14 connected to a first end 13 of the means 12 (e.g., a handle). In accordance with an embodiment of the present invention, a means for contacting 16 the edges 200*a*,200*b* of the butt joint 100 is configured to apply a force to the protruding drywall edges and debris to effectively eliminate the protruding raised/frayed edges and reduce the drywall debris. The means for contacting may comprise a wheel (e.g., a rotatable wheel) connected to an opposing end 15 of the handle 12 (e.g., the blade is positioned on an end of the handle opposite the wheel).

When rotatable, the wheel 16 may be configured to include a central aperture (not shown), with a pin 17 disposed through the aperture and connected to opposing end 15 of handle 12. In this manner, wheel 16 is operable to freely rotate around the pin 17 so that, in accordance with this embodiment of the present invention, wheel 16 may roll along the extent of the butt joint 100.

In this embodiment, as the rotatable wheel 16 contacts the rough paper edges 200*a*, 200*b* of the butt joint 100 the contact forces the edges 200*a*,200*b* and drywall debris exposed along both cut edges 200*a*,200*b* of the butt joint 100 downwards (into the surface), embedding this debris below the top, surface of the drywall in a quick and easy manner. Once wheel 16 has been rolled along a seam, a section of fibertape can be applied to the prepared surface, with little or no drywall debris present along the seam.

Figure 3:
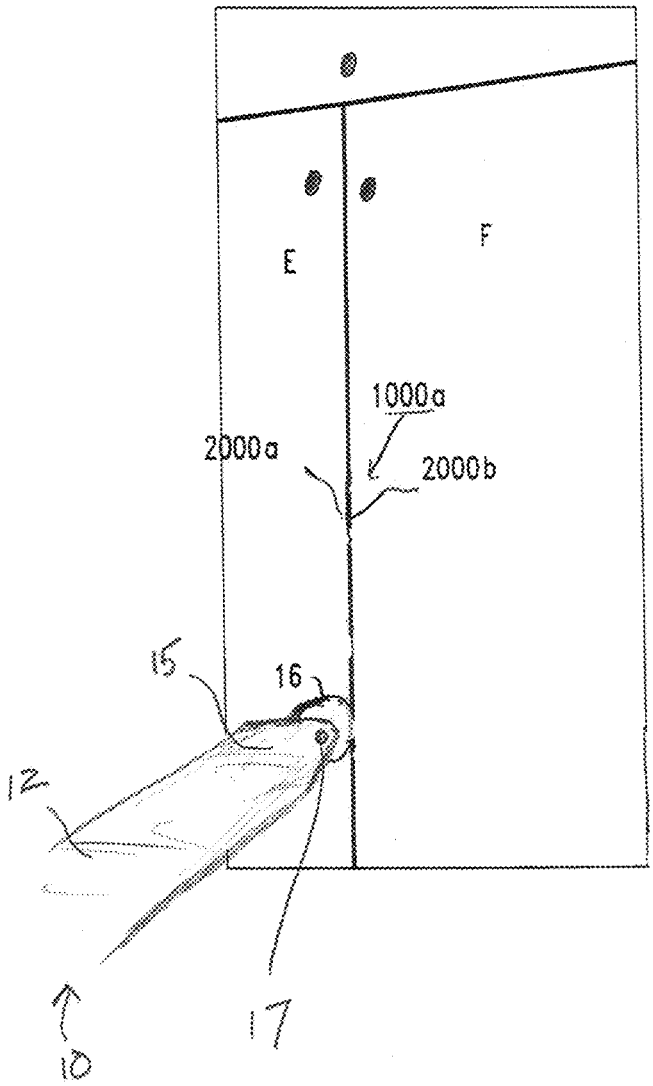
FIG. 3 illustrates another exemplary device in accordance with an embodiment of the present invention.
Figure 4:
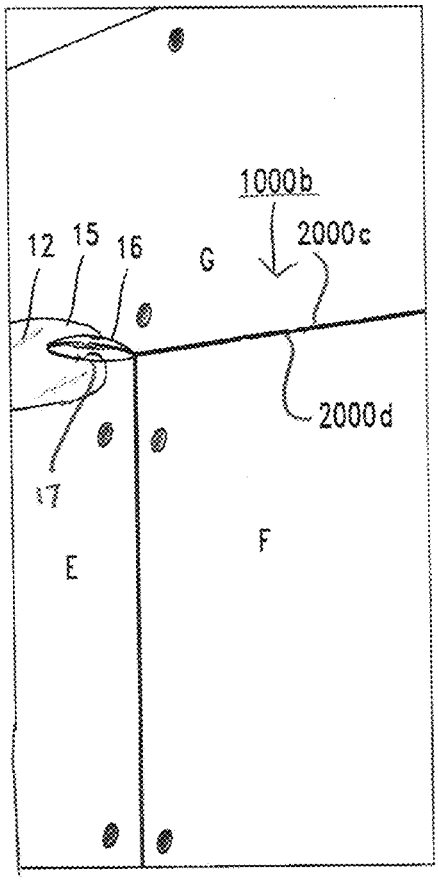
FIG. 4 illustrates exemplary method of preparing a horizontal drywall butt joint in accordance with an embodiment of the present invention.

Referring now to FIG. 3, there is illustrated a method of preparing a drywall butt joint 1000*a* using the tool 10. As shown, the wheel 16 may be placed and then, rolled along a vertical butt joint 1000*a* between two edges 2000*a*,2000*b* of drywall sections E, F. In an embodiment, the wheel 16 comprises beveled surfaces "S" and a flat circumference ridge portion "R" and is configured to apply a force to the protruding drywall edges and debris to effectively eliminate the protruding raised/frayed edges and reduce the drywall debris (surfaces "S" are better shown in FIG. 5). In FIG. 4, there is shown an embodiment where the rolling wheel 16 may be rolled along a'horizontal butt joint 1000*b* formed by edges 2000*c* and 2000*d*.

Figure 5:
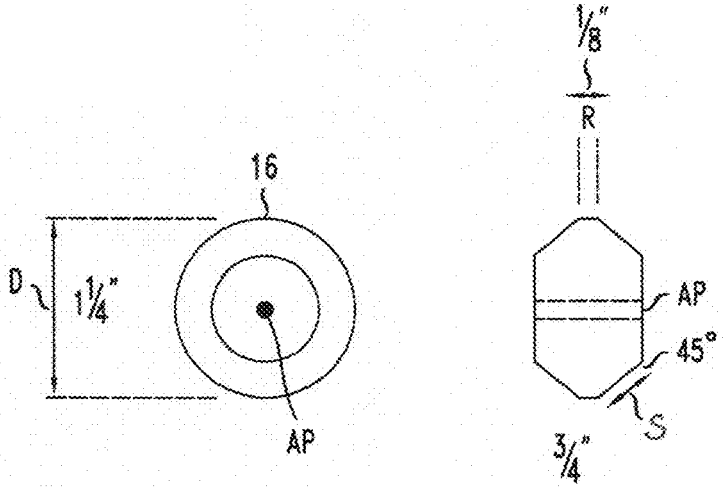
FIG. 5 illustrates an element of a device in accordance with an embodiment of the present invention.

In one embodiment, wheel 16 has a diameter "D" on the order of about 1¼", with a thickness "T" of about ¾" and a central ridge portion "R" of the flattened. V-shaped or circumference about ⅛", as shown in FIG. 5. By "flat ridge portion" is meant that instead of the surfaces "S" of the wheel forming a point, in this embodiment there exists a ridge portion "R" at the circumference. It should be understood that the dimensions of a wheel means may be varied to treat various butt joint and edge sizes.

A central aperture "AP", used to engage with pin 17, is shown in FIG. 5 as well. In an embodiment, the beveled sides "S" of the circumference may form an angle of about 45°, for example, where the beveled sides "S" assist in embedding the drywall debris below the surface of a butt joint, for example.

It should be understood that the beveled surfaces "S" and ridge portion R form just one of the shapes that, the wheel means may be configured as to effectively eliminate protruding raised/frayed edges and reduce drywall debris.

Further, while the embodiments illustrated in the figures depict an embedding tool combined with a putty knife, it should be understood that in other embodiments a tool may also be configured as a separate item (e.g., without the blade).

Figure 6:
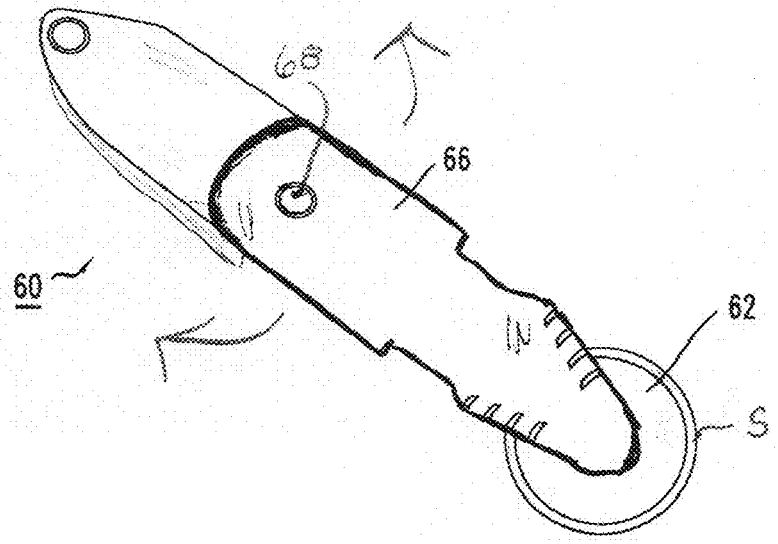
FIG. 6 illustrates yet another exemplary device in accordance with an embodiment of the present invention.

FIG. 6 illustrates another view of an exemplary embedding tool 60 in accordance with another embodiment of the present invention. As shown the tool 60 may comprise a fixed wheel means 62 attached at one end 64 of a handle means 66 in a manner such that fixed wheel means 62 does not rotate as embedding tool 60 is moved along a butt joint. As shown, fixed wheel means 62 comprises beveled sides "S" to assist in the process of effectively eliminating protruding raised/frayed edges and embedding drywall debris below the surface of a butt joint. In this embodiment, there is no blade as in FIG. 2.

Therefore, while some embodiments of the present invention may utilize a rotatable wheel, other embodiments include a wheel that is fixed in place at one end of a handle means, with the user sliding the fixed "wheel" along the butt joint to perform the embedding of protruding raised/frayed edges and drywall debris.

In an alternative embodiment, rather than use a wheel another exemplary embedding tool may comprise a rounded end taper (e.g., plastic end) that comprises tapered side surfaces and a rounded end surface, where the user's action of drawing the end taper along a butt joint results in embedding the edges and debris of a butt joint below the joining surface. Once the rounded end taper has been applied along a seam, a section of fibertape can be applied to the prepared surface, with little or no drywall debris present along the seam.

Figure 1:
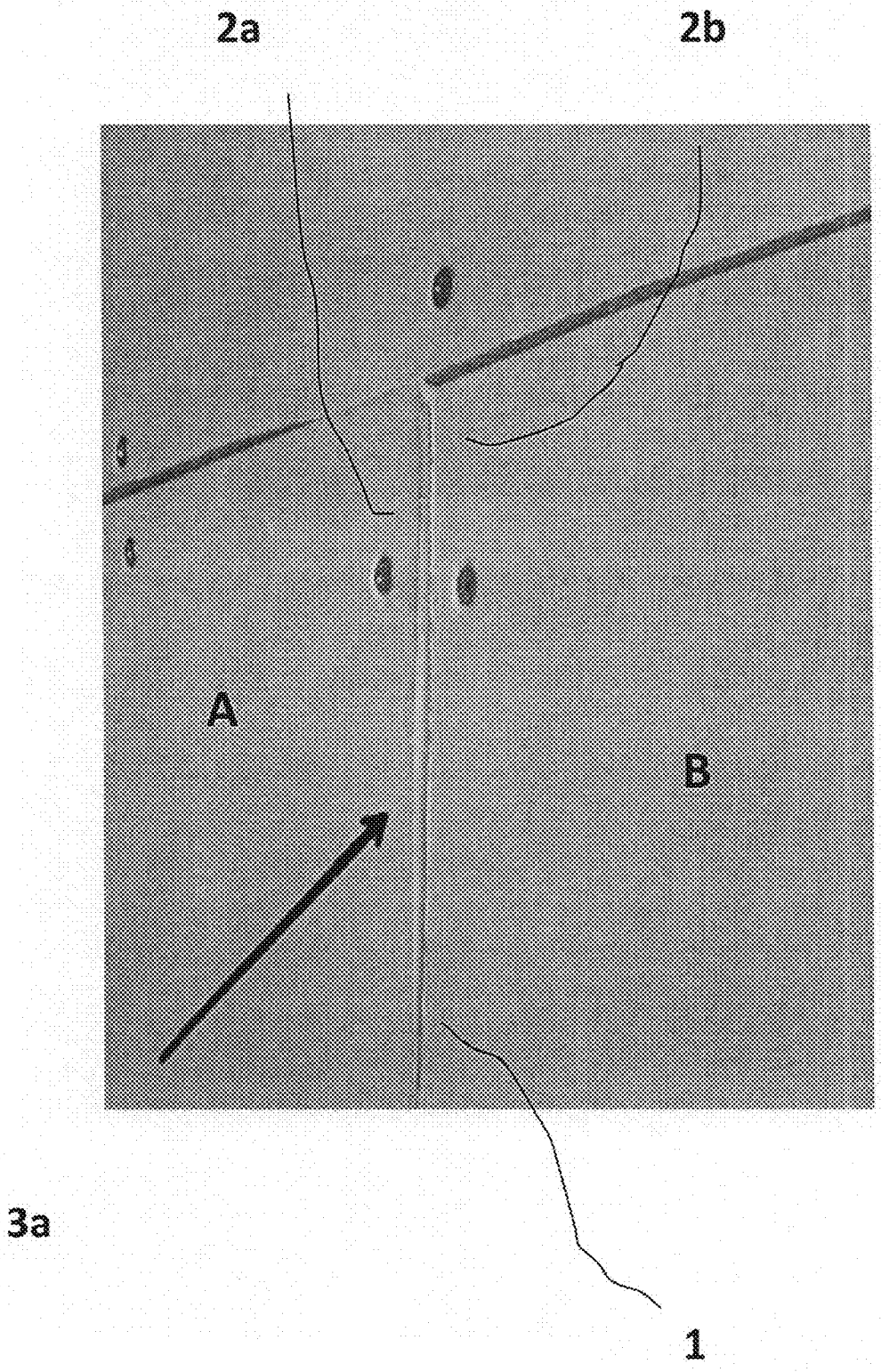
Figure 7:
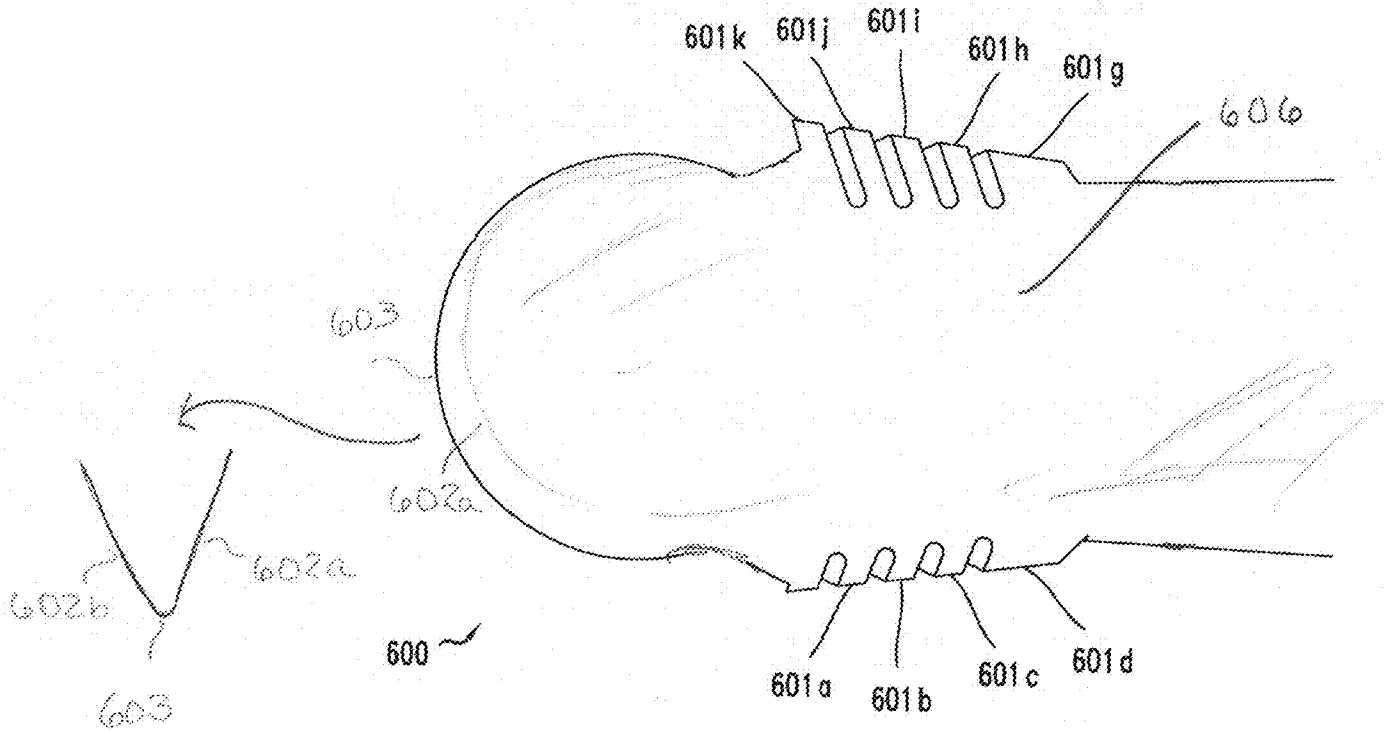
FIG. 7 illustrates still another exemplary device in accordance with an embodiment of the present invention that includes one or more raised surfaces or grips.

Referring now to FIG. 7 there is shown this alternative embodiment of a tool 600 including a rounded end taper 602. As shown, only the end of tool 600 that includes rounded end taper 602, with the understanding that the complete tool 600 further comprises similar elements (e.g., blade) as in FIG. 1. Additionally, handle portion 603 of tool 600 includes one or more gripping means 601*a* to *k* for forming a secure connection between a user's hands or fingers (not shown) and the tool 600 (e.g., raised surfaces or grips 601*a* to *k*, where "k" represents the last raised surface or grip).

Although exemplary devices and methods have been described and illustrated, it should be understood that the specific features or elements shown may be reshaped, resized, repositioned, or otherwise modified in order to be compatible with alternate applications without departing from the scope of the present invention. Further, it is understood that one or more elements, such as the wheel, may be detachable or replaceable or be adjustable. For example, in the embodiment of FIG. 6, handle 66 may include an adjustment means 68 for turning the handle between 0 and 90 degrees (to the left or right of a reference, vertical position) so that the tool may be used to prepare both vertical and horizontal edges without needing to change the position of a user's arms or shoulders from vertical to a horizontal-like position and vice-versa.

Yet further, it should be understood that the devices and/or elements described herein may include, be connected to, or be combined with additional devices, elements or means related to the preparation of drywall joints, such as a means for illuminating, for example a surface or joint being worked on (e.g., an LED light and power source, such as a battery). Still further, a motor means (e.g., motor and motor assembly) may be combined with the devices described herein and connected to the wheel means to rotate the wheel means, for example, automatically or semi-automatically (little force has to be applied by a user's hands or fingers).

In sum, while exemplary embodiments have been shown and described herein, it should be understood that variations of the disclosed embodiments may be made without departing from the scope of the claims that follow.

I claim:

1. A device for preparing a drywall butt joint comprising:

a means for contacting edges of a butt joint, the means configured to apply a force between protruding drywall edges and debris, and comprising surfaces configured to eliminate the protruding edges and reduce the debris to allow more joint compound into the joint to strengthen the joint;

a handle having opposing first and second ends, the means for contact edges of a butt joint attached to the first end of the handle; and a putty knife attached to the second end of the handle.

2. The device as in claim 1 wherein the means for contacting comprises a wheel comprising beveled surfaces and a circumference ridge portion.

3. The device as in claim 2 wherein the wheel is detachable from the handle or replaceable.

4. The device as in claim 2 wherein the wheel comprises a rotatable wheel.

5. The device as in claim 2 wherein the wheel comprises a fixed wheel.

6. The device as in claim 1 wherein the means for contacting comprises an end taper.

7. The device as in claim 1 wherein handle comprises an adjustment means for turning between 0 and 90 degrees from a vertical position.

8. The device as in claim 1 further comprising a gripping means formed along the handle for forming a secure connection between a user's hands or fingers and the device.

9. The device as in claim 1 further comprising means for illuminating a surface or joint.

10. A method for preparing a drywall butt joint comprising:

providing a motorized embedding tool including a rotatable wheel attached to a first end of a handle, the embedding tool including a motor attachable to the wheel for providing rotation thereof under the user's control;

contacting protruding edges or debris of the butt joint with the rotatable wheel portion of the motorized embedding tool;

activating the motor to initiate rotation of the wheel, and moving the handle of the motorized embedding tool along the drywall butt joint so as to apply a force to the edges and debris to eliminate the protruding edges and reduce the debris to allow more joint compound into the joint to strengthen the joint.

11. The method as in claim 10 wherein the rotatable wheel comprises beveled surfaces and a circumferential ridge portion.

12. The method as in claim 10 wherein the rotatable wheel is detachable from the handle or replaceable.

13. The method as in claim 10 wherein the edges are vertical or horizontal edges of drywall.

14. The method as in claim 10 further comprising the step of illuminating at least the butt joint.

* * * * *